United States Patent [19]

Goon et al.

[11] 4,243,013

[45] Jan. 6, 1981

[54] FOOD WARMER

[76] Inventors: Harry Goon, c/o George Spector, 3615 Woolworth Bldg., 233 Broadway; George Spector, 3615 Woolworth Bldg., 233 Broadway, both of New York, N.Y. 10007

[21] Appl. No.: 48,142

[22] Filed: Jun. 13, 1979

[51] Int. Cl.[3] ..... F24C 5/00

[52] U.S. Cl. ..... 126/43

[58] Field of Search ..... 126/43; 431/331; 74/89.15

[56] References Cited

U.S. PATENT DOCUMENTS

| | | | |
|---|---|---|---|
| 1,389,614 | 9/1921 | Ball | 431/331 |
| 2,464,817 | 3/1949 | Laliberte | 126/43 |
| 2,814,286 | 11/1957 | Arnold | 126/43 |
| 3,025,849 | 3/1962 | Zimmerman | 126/43 |
| 3,144,615 | 8/1964 | Jankowski | 126/43 |
| 3,361,126 | 1/1968 | Bloomfield | 126/43 |
| 3,371,659 | 3/1968 | Paspalas | 126/43 |

*Primary Examiner*—Samuel Scott
*Assistant Examiner*—Wesley S. Ratliff, Jr.

[57] ABSTRACT

A food warming stove suitable for placement upon a serving or dining table, and including a shell mounted upon a revolving turn table, the shell enclosing several braziers each of which holds a quantity of sterno canned heat burning compound for producing flames under hot plates adaptable for placement of cooking vessels thereupon, so to warm various foods.

4 Claims, 6 Drawing Figures

FOOD WARMER

This invention relates generally to food warming appliances.

A principal object of the present invention is to provide an improved food warmer which is capable of warming up several vessels of various foods, each to its own individual temperature, the food warmer being attractive in appearance, so that it is ideal for use upon a serving or dining table, either at a large party or at a family meal.

Another object is to provide a food warmer which incorporates its owne rotating turn table, so that a person can readily move any food vessel closely enough for serving himself without need of reaching across other vessels.

Yet another object is to provide a food warmer which utilizes a burning fuel, so to not have any unsightly electric wires extending therefrom, and which accordingly, can be placed anywhere indoor within a home or outdoor such as on a terrace or patio, for gracious dining.

Yet a further object is to provide a food warmer which is designed to include flame controls in order to create variable sizes of heating areas and variable heat intensity of the flames.

Figures 1, 2, 3, 4, 5, 6:
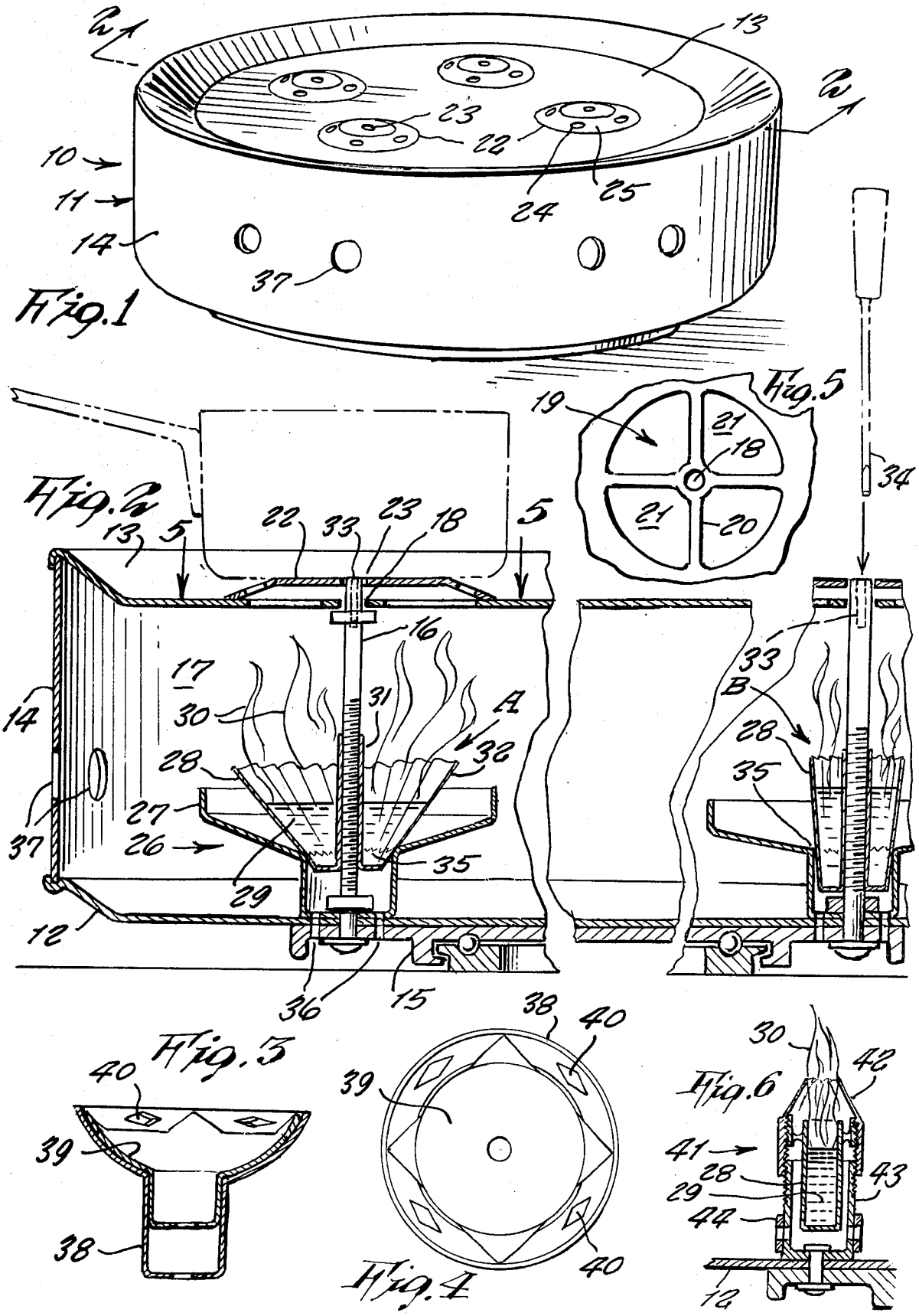
FIG. 1 is a perspective view of the invention.
FIG. 2 is a cross sectional view on line 2—2 of FIG. 1 and showing the stearno burner receptacles to be adjustable in diametrical size in order to produce either a larger or smaller fire, by raising or lowering the receptacle by a wrench.
FIG. 3 is a side cross sectional view of another design of receptacle and its holder.
FIG. 4 is a top view thereof.
FIG. 5 is a view in direction 5—5 of FIG. 2.
FIG. 6 is a side cross sectional view of still another design of burner.

Referring now to the drawing in greater detail, and more particularly to FIGS. 1 and 2 thereof at this time, the reference numeral 10 represents a food warmer according to the present invention wherein there is a circular hollow shell 11 comprised of a bottom pan 12, a top pan 13 and an cylindrical side wall 14 therebetween. The shell components are made of lustrous sheet metal so to be attractive in appearance.

A turn table 15 is secured under the shell, so as to allow easy rotation thereof.

Four spaced apart bolts 16 secure the bottom pan and turntable together, the bolts extending vertically upwardly through the shell interior 17 and through openings 18 in the top pan, the opening 18 being in a center of a grate 19 formed by radially extending spokes 20 between large holes 21. Above each grate, an upwardly dished, circular hot plate 22 is secured so that pots or other food vessels can be placed thereupon for warming of foods contained therein. A center hole 23 in the hot plate receives the upper end of the bolt 16. Several holes 24 on inclined peripheral area 25 of the hot plate allows heat to pass upwardly therethrough and strike an underside of overlapping portion of the pot bottom wall.

A burner 26 under each hot plate comprises a brzier 27 secured by the bolt 16 upon the bottom pan, the bolt passing through the center of the brazier. A receptacle 28 is nested upon a center of the brazier, the receptacle containing sterno canned heat fuel 29 which can be ignited by a match in order to produce flames 30 for heating the hot plate thereabove. The receptacle is made with an upward extending internally threaded, center sleeve 31 in which the bolt 16 is thread engaged, the sleeve preventing the liquified fuel from running out of the receptacle. The receptacle is made of a flexible sheet spring metal material, and is shaped like a conventional cup cake paper form by having a conical side wall 32 that is pleated, which naturally tends to open outward like a flower blossom.

A hexagonal hole 33 in a top of the shaft 16 serves to receive a hexagonal screw driver like tool 34 for rotating the screw and thus cause the receptacle 28 to be raised or lowered along the screw. A toothed edge 35 of the brazier engages the receptacle pleats so to prevent rotation of the receptacle when the bolt is turned. When the receptacle is raised as shown at A in FIG. 2, the receptacle moves higher above the toothed edge 35 so to allow the receptacle to freely open up wide. Thus a larger surface of the liquidfied tool is made so that a big burning flame area results, as shown. When the screw is rotated in an opposite direction, the receptacle is pulled downwardly past the edge 35, thus causing the pleated wall of the receptacle to start closing up as shown at B in FIG. 2, so that a smaller surface area of the fuel results in less flames. Thus heat is controlled by a size of the fuel burning area.

Holes 36 at the bottom of the device and holes 37 on the shell side wall 14 provide air for the flames.

In FIGS. 3 and 4 another design of brazier 38 and receptacle 39 are shown. The brazier includes air vent openings 40 below its upper edge so to feed flames in the receptacle, the receptacle upper edge being notched so to clear the openings 40.

In FIG. 6, another design of burner 41 has the feature that a conical opening at a top thereof can be inwardly opened or closed selectively more or less so as to control the flame area, and the receptacle can be selectively raised or lowered so as to be closer or further from the hot plate, thus controlling the heat intentity.

The burner 41 includes a cone 42 threaded upon sleeve 43 so that the cone can be raised or lowered. A receptacle 43 threaded inside the cone causes the cone top opening to spread open when the receptacle is screwed upwardly. The cone top opening closes when the receptacle is lowered. The conical upper part of the cone is pleated and made of a similar material as the above described receptacle 28. A rotatable ring 44 controls air to the flames.

What is claimed:

1. A food warmer, comprising in combination, a hollow shell mounted upon a rotable turn table, a plurality of burners inside said shell and a hot plate on said shell above each said burner, each burner including a brazier with a receptacle therein receiving sterno canned heat fuel, and said receptacle being expanded in diameter when raised upward out said brazier.

2. The combination as set forth in claim 1, wherein said brazier comprises a wider upper portion, a narrow lower portion, and a circular edge therebetween said edge being toothed.

3. The combination as set forth in claim 2, wherein said receptacle comprises a vessel of flexible spring steel having a pleated side wall engaging said toothed edge, and said receptacle having a central sleeve threaded on its inner side.

4. The combination as set forth in claim 3, wherein a rotatable bolt supported through a bottom of said shell, is threaded in said receptacle sleeve, an upper end of said bolt protruding through a top of said shell, a hexagonal opening in a top of said bolt engaging a heragonal tool for rotation of said shaft.

* * * * *